US011352753B2

(12) United States Patent
Habodasz

(10) Patent No.: US 11,352,753 B2
(45) Date of Patent: Jun. 7, 2022

(54) MODULAR PANEL FOR PROTECTING PARAPET STRUCTURES

(71) Applicant: Anthony P. Habodasz, Troy, OH (US)

(72) Inventor: Anthony P. Habodasz, Troy, OH (US)

(73) Assignee: POLY SALT ARMOR LLC, Troy, OH (US)

( * ) Notice: Subject to any disclaimer, the term of this patent is extended or adjusted under 35 U.S.C. 154(b) by 550 days.

(21) Appl. No.: 16/256,052

(22) Filed: Jan. 24, 2019

(65) Prior Publication Data

US 2019/0226164 A1 Jul. 25, 2019

Related U.S. Application Data

(60) Provisional application No. 62/621,680, filed on Jan. 25, 2018.

(51) Int. Cl.

| | |
|---|---|
| ***E01F 15/08*** | (2006.01) |
| ***E01F 15/02*** | (2006.01) |
| ***E01D 19/10*** | (2006.01) |

(52) U.S. Cl.

CPC ..... *E01D 19/103* (2013.01); *E01F 15/02* (2013.01); *E01F 15/08* (2013.01); *E01F 15/083* (2013.01)

(58) Field of Classification Search

CPC . E01F 15/00; E01F 15/02; E01F 15/04; E01F 15/08; E01F 15/081; E01F 15/083; E01F 15/085; E01F 15/088; E01F 15/14; E01F 15/15; E01F 15/146; E01F 13/00; Y10T 24/44009; Y10T 24/44017; Y10T 24/44026

USPC ..... 404/6

See application file for complete search history.

(56) References Cited

U.S. PATENT DOCUMENTS

| | | | | |
|---|---|---|---|---|
| 1,950,719 A * | 3/1934 | Edge | ..... | E01F 15/02 256/13.1 |
| 3,678,815 A | 7/1972 | Younker | | |
| 3,957,383 A | 5/1976 | Fredericks | | |
| 4,348,133 A | 9/1982 | Trent et al. | | |
| 4,419,850 A | 12/1983 | Butzen | | |
| 4,496,264 A | 1/1985 | Casey | | |
| 4,550,535 A | 11/1985 | Drogosch | | |

(Continued)

FOREIGN PATENT DOCUMENTS

| | | | | |
|---|---|---|---|---|
| BE | 899021 A * | 6/1984 | ..... | E01F 15/083 |
| DE | 102005021422 A1 * | 11/2006 | ..... | E01F 15/085 |

(Continued)

OTHER PUBLICATIONS

Impact-absorbing Road Side Barrier, Jun. 18, 1984, Google Patents Translation of BE 899021 A (Year: 1984).*

*Primary Examiner* — Josh Skroupa
*Assistant Examiner* — Zachary A Hall
(74) *Attorney, Agent, or Firm* — Mattingly & Malur, PC

(57) ABSTRACT

A modular cover panel including two or more cover panels that cover a parapet or barrier along a roadway. Multiple cover segments may overlap one another to form the modular cover panel and each cover panel is individually hung or suspended by brackets affixed to the parapet. Each cover segment has one more surfaces intersecting with other to cover the parapet and a top surface that overhangs a top surface of the parapet. A cable may be disposed through a slot of a hanging bracket and a pin may secure the cable thereby providing a mechanical attachment to the assembly.

27 Claims, 7 Drawing Sheets

(56) References Cited

U.S. PATENT DOCUMENTS

| | | | | | |
|---|---|---|---|---|---|
| 4,553,875 | A * | 11/1985 | Casey | E01F 15/086 | 249/5 |
| 4,964,248 | A | 10/1990 | Braine et al. | | |
| 5,118,216 | A * | 6/1992 | Smith | E01F 15/083 | 256/13.1 |
| 5,217,318 | A * | 6/1993 | Peppel | E01F 15/146 | 256/13.1 |
| 5,746,538 | A | 5/1998 | Gunness | | |
| 5,860,762 | A * | 1/1999 | Nelson | E01F 15/083 | 404/6 |
| 6,413,009 | B1 * | 7/2002 | Duckett | E01F 15/083 | 404/6 |
| 6,533,250 | B2 | 3/2003 | Arthur | | |
| 6,551,011 | B1 | 4/2003 | Valentine | | |
| 6,669,402 | B1 * | 12/2003 | Davis | E01F 15/086 | 256/13.1 |
| 6,840,706 | B1 | 1/2005 | Camomilla et al. | | |
| 7,168,882 | B1 | 1/2007 | Owen | | |
| 7,303,353 | B2 * | 12/2007 | Carey | E01F 15/086 | 404/6 |
| 8,561,367 | B2 | 10/2013 | Kelly | | |
| 8,622,648 | B2 | 1/2014 | Mustafa | | |
| 8,656,678 | B2 | 2/2014 | Macdonald | | |
| 9,598,827 | B1 | 3/2017 | Pavloff, Jr. et al. | | |
| 9,821,216 | B2 * | 11/2017 | Kurtin | A63C 19/06 | |
| 10,577,827 | B2 * | 3/2020 | Kurtin | A63C 19/10 | |
| 2004/0197140 | A1 | 10/2004 | Maleska | | |
| 2006/0159516 | A1 * | 7/2006 | Schmitt | E01F 15/025 | 404/6 |
| 2013/0105475 | A1 * | 5/2013 | Marshall | B65D 90/24 | 220/4.12 |
| 2013/0108361 | A1 * | 5/2013 | Mustafa | E01F 15/083 | 404/6 |
| 2013/0248791 | A1 * | 9/2013 | Bullock | E01F 15/06 | 256/13.1 |
| 2014/0373310 | A1 * | 12/2014 | Leo, II | H02G 3/32 | 24/129 R |
| 2015/0010353 | A1 | 1/2015 | Povoli | | |
| 2016/0268793 | A1 | 9/2016 | Partridge et al. | | |

FOREIGN PATENT DOCUMENTS

| | | | | | |
|---|---|---|---|---|---|
| FR | 2660333 | A1 | | 10/1991 | |
| GB | 2512118 | A | * | 9/2014 | E01F 15/085 |
| GB | 2544094 | A | * | 5/2017 | E01F 15/06 |
| KR | 200195925 | Y1 | * | 9/2000 | |
| KR | 200196465 | Y1 | * | 9/2000 | E01F 15/006 |
| KR | 200320639 | Y1 | * | 7/2003 | E01F 15/083 |
| KR | 20030066677 | A | * | 8/2003 | E01F 15/12 |
| KR | 20070057742 | A | * | 6/2007 | |
| KR | 20080067035 | A | * | 7/2008 | |
| KR | 100897583 | B1 | * | 5/2009 | |
| KR | 20090120730 | A | * | 11/2009 | |
| KR | 20110054700 | A | * | 5/2011 | |
| KR | 20110083575 | A | * | 7/2011 | |
| KR | 101056065 | B1 | * | 8/2011 | |
| KR | 20130019483 | A | * | 2/2013 | |
| KR | 20140095870 | A | * | 8/2014 | |
| KR | 101448982 | B1 | * | 10/2014 | E01F 15/146 |
| KR | 101705515 | B1 | * | 2/2017 | |
| KR | 102120311 | B1 | * | 6/2020 | |
| WO | WO-02055790 | A1 | * | 7/2002 | E01F 15/006 |

* cited by examiner

MODULAR PANEL FOR PROTECTING PARAPET STRUCTURES

CROSS-REFERENCE TO RELATED APPLICATION

This application claims the benefit of U.S. Provisional Application No. 62/621,680 filed Jan. 25, 2018. The contents of which is hereby incorporated by reference.

SUMMARY

In areas where snow and ice accumulate, the snow and/or ice is usually removed from the road by a snow plow or other snow removal device. Road salts, chemicals, and other materials incidentally adhere to parapets, walls, or border structures along the road. In many instances, parapets are concrete barriers that are placed on the external edges of a bridge and may consist of concrete, which may be porous. Therefore, chemicals (e.g., road salts) and fluids (e.g., rain water, ice, or otherwise) may seep into or be absorbed into the concrete of the parapet. As a result, over time the concrete of the parapet erodes or deteriorates and spalling of the concrete of the parapets occurs necessitating major repair, which is costly. Spalling of the parapets presents a danger as pieces of deteriorated concrete may fall onto the road below.

One of the consequences of this salt usage is the deterioration of concrete structures due to the corrosive effects of that salt. The inevitable consequence of plowing highways is that salt laden snow ends up stacked against the bridge parapets, thus providing more contact with the salt than occurs on other parts of the structure where the salt can simply wash or drain off. Parapet walls present a particular problem. Parapets are more susceptible to cracking and corrosion problems than other members. Parapets are also exposed on the top of the bridges. This makes them more susceptible to thermal cracking and freeze/thaw cycling.

The modular panel for the parapets have multiple panel segments, for instance, that prevent the deterioration of the concrete by protecting it from the elements and chemicals, such as salt and other chemicals. For instance, the modular panels prevent salts, chemical solutions, and other matter from contacting the surface of the parapets, walls, etc. to prevent the deterioration or cracking of the concrete structure that forms the parapet/wall, without affecting the structural integrity of the structure once the panel is installed. The cover may accommodate supports of any height and any shape.

The panel segments when connected together are aesthetically appealing. The modular panel is easy to install, cost effective, and environmentally friendly. The cover is lightweight, may be made of recyclable/recoverable material (green technology), and reduces safety issues/hazards that normally are associated with industry standard maintenance practices, such as the painting along roadways. Upon application of the present invention, road closures would be less frequent and bridge support life cycles would be longer.

One preventative measure available to inhibit corrosion of the concrete support is supplied by routine painting of the parapets. However, painting is expensive, poses a safety risk to workers, and disrupts traffic in areas where the maintenance is taking place. Also, the paint only lasts for a short period of time. Accordingly. the painting process only assists in the preventative maintenance, and becomes a continuous/recurring procedure.

For example, the Ohio Department of Transportation (ODOT) has identified that premature bridge parapet cracking is a prominent problem. Various districts within ODOT have expressed concerns about bridge parapet cracking. Cracking can range from small hairline cracks to large cracks that expose rebar. Therefore, parapet cracking is not only an aesthetic concern, but it can also be a safety concern. Repairing parapets before the bridge deck needs to be repaired is very costly.

Cracking in concrete can occur for various reasons such as shrinkage cracking, flexural stresses, reinforcement corrosion, and construction practices. The corrosion of steel reinforcement within concrete can also cause the parapet to crack. If the reinforcement is exposed to moisture, oxygen and chlorides, then the steel begins to oxidize. Corrosion of the steel produces iron oxides and hydroxides that have a volume much greater than the volume of the original metallic iron. The best way to reduce the chance of corrosion, is to make sure the concrete cover over the reinforcement is thick enough, and to use concretes that have a low permeability. Corrosion of the concrete can also affect the bond between the reinforcement and concrete. Over a period of time the adhesion bond between the steel and the concrete undergoes breakdown. This breakdown can cause an increase in crack width and depth. When cracking in concrete occurs, it allows water and other contaminants to enter. Once inside, water has the ability to expand as it freezes in colder temperatures which can increase the size of the crack or even break concrete off the structure. Also, salts that enter the concrete can cause reinforcement within the concrete to corrode. This corrosion can compromise the integrity of the structure. Since cracks can allow unwanted substances to enter the concrete, and create ideal conditions for corrosion, it is important to reduce parapet cracks. This is especially important in northeast Ohio where parapet cracking is a significant problem.

SUMMARY

In some instances a panel may include a main surface and a back surface that is opposite the main surface and span in a width direction of the panel; a first side and a second side spanning in a height direction along opposite sides of the panel, respectively. Further, the main surface may include: a flat and essentially horizontal top surface; an angled surface extending downward at a first angle from the top surface; a first surface extending downward at a second angle, which is different from the second angle, from the top surface; a second surface extending downward at an angle from the first surface; and a lower surface extending downward at an angle from the second surface. In some examples, the lower surface is lower than the second surface, which is lower than the first surface, which is lower than the top surface in the height direction. Additionally, at least two through-holes may be disposed through the main surface and the back surface that are configured to accept respective brackets.

DETAILED DESCRIPTION

The modular cover panel includes cover panel segments or sections that have side portions overlapping each other to provide a surface of protection while covering the parapet or barrier. The panel may be adapted and modified to fit around parapet structures of many shapes and sizes. The panel also may be used for any type of structure such as those found along road ways including, but not limited to safety barriers, walls, barrier rails, and "Jersey" barriers. Additionally, the parapet segments of the modular panel may be injection molded, by standard plastic manufacturing process methods & materials, such as thermoforming, blow molding, compression, rotomold, and forms of injection molded processes. The panel may be made by structural foam injection molding and may be made according to the shape of the parapet to be covered and the cover is not limited to any of the mold process listed above.

Figure 1:
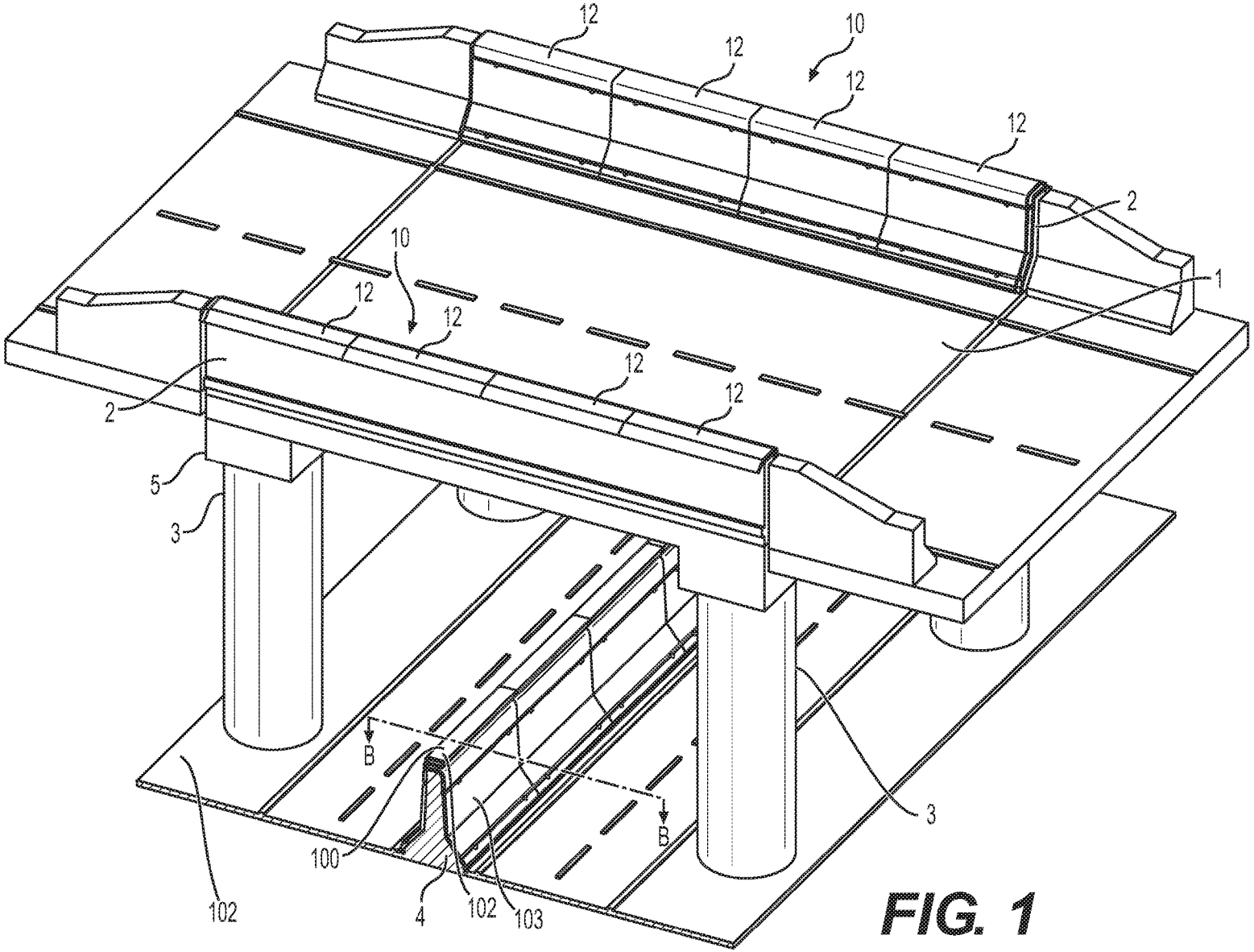
FIG. 1 illustrates an example of a modular cover panel and a modular center divider cover panel according to some implementations.

FIG. 1 illustrates an example of an overpass or a bridge including a road deck according to some implementations. The road deck of the bridge 1 may include parapets 2 on either side of the roadway 1, which may be a protective wall or barrier along the edge of the road 1 which may function to prevent vehicles or debris from falling off. As shown, the bridge or overpass roadway 1 is over a lower road which has a center divider 4 dividing two roads. The roadway of the bridge 1 may be supported by support columns 3 and have a horizontal beam 5 for supporting the roadway 1.

A modular cover panel 10 consisting of multiple cover panels 12 covering portions of the parapets 2 is shown according to some implementations. As described in more detail below, adjacent cover panels 12 may engage or contact one another to form the modular cover panel 10. In some implementations, a side portion of a cover segment may overlap a side portion of an adjacent cover panel 12. Further, FIG. 1 shows four cover panels 12 installed on one side of the roadway 1, but two or more cover panels 12 may be assembled or installed to form the modular cover panel 10 to cover the parapet as necessary.

Figure 2:
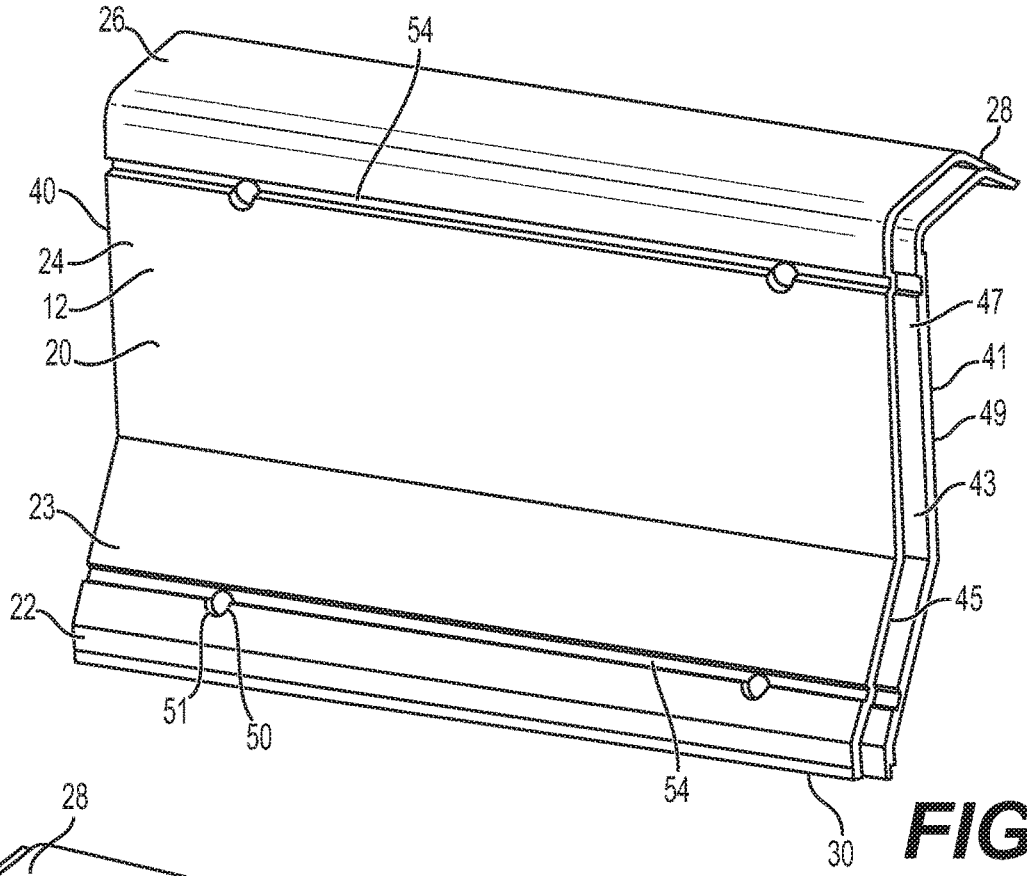
FIG. 2 illustrates an example of a cover panel in a perspective view according to some implementations.
Figure 3:
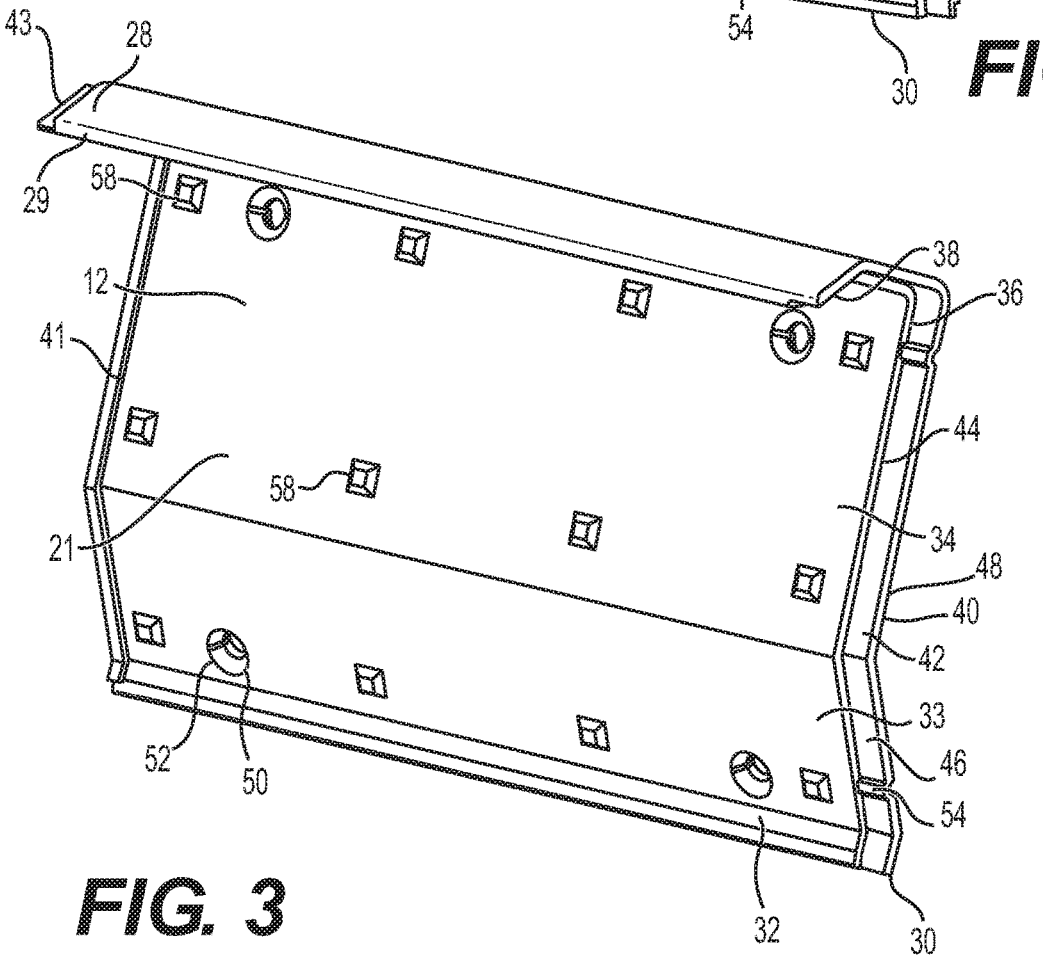
FIG. 3 illustrates an example of a cover panel in a perspective view according to some implementations.
Figure 4:
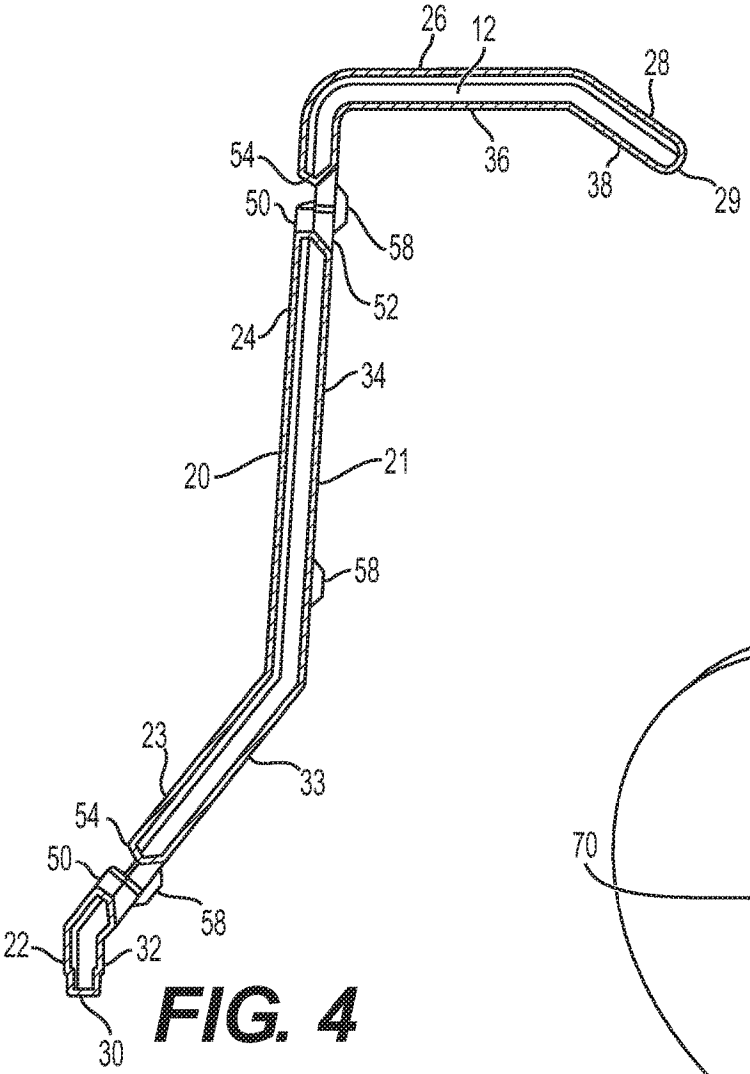
FIG. 4 illustrates an example of a side view of a cover panel according to some implementations.

FIG. 2 illustrates an example of a cover panel in a perspective view according to some implementations. FIG. 3 illustrates an example of a cover panel in a perspective view according to some implementations. FIG. 4 illustrates an example of a side view of a cover panel according to some implementations. The cover panel 12 may be a single homogenous piece. The shape or structure of the cover panel 12 may essentially correspond with the shape and design of the outer surface(s) of the parapet 2. Accordingly, in some implementations, the cover panel 12 may have surfaces that are essentially flat and have surfaces that are angled with respect to one another. In some examples, the outer surface of the cover panel 12 has portions that are in different planes that correspond to the outer surface of the parapet 2. For example, some parapets 2 may have a top surface that is parallel to the roadway 1.

In some implementations, a cover panel 12 may include an outer surface (or main surface) 20 and an inner surface 21 or back surface that is opposite to the outer surface 20. The inner surface 21 faces the outer surface of the parapet 2 when installed. The outer surface 20 may include a top surface 26 that is parallel to a top surface of the parapet (and thus parallel to the road surface according to some examples). The term surface may be used herein to denote a wall, flange, or planar portion of the outer surface 20 or inner surface 21, for example. Additionally, the surfaces 20, 21 and portions thereof may be planar and/or essentially flat. Extending from the top surface 26 and away from the roadway 1, the outer surface 20 may include an angled surface or planar portion 28 that is angled downward with respect to the top surface 26 so as to allow fluid to travel away and off the ultimate edge 29 of the cover panel 12. The angled surface 28 may extend far enough away from the roadway and bridge that the liquid dripping or falling off the edge 29 falls off the bridge without contacting the parapet 2 (and onto the roadway below). In some examples, the edge 29 may be rounded or square or have a different shape in cross-section that allows liquid to fall off the edge 29 due gravity and the downward slope of the edge 29.

The outer surface 20 may also include a first vertical surface 24 that extends downward in the vertical direction toward the roadway 1 and may span the width of the cover panel 12. The angle of the first vertical surface 24 with respect to the top surface 26 is different than the angle of the top surface 26 with respect to the angled surface 28. The first vertical surface 24 may intersect a plane of the top surface 26 at an angle depending on the shape of the parapet 2 to be covered. Further, the dimensions of the first vertical surface 24 may correspond with the dimensions of the corresponding portion of the parapet 2 to be covered by the cover panel 12. The intersection of the planar first vertical surface 24 and the planar top surface 26 may have a rounded or square elbow or corner.

In some implementations, the outer surface 20 may include a second vertical surface extending 23 downward from the first vertical surface 24 and may span the width of the cover panel 12. The second vertical surface 23 may intersect a plane of the first vertical surface 24 at an angle depending on the shape of the parapet 2 to be covered. Further, the dimensions of the second vertical surface 23 may correspond with the dimensions of the corresponding portion of the parapet 2 to be covered by the cover panel 12.

In some implementations, the outer surface 20 may include a lower vertical surface 22 extending downward in the vertical direction from the second vertical surface 23 and may span the width of the cover panel 12. A plane of a lower vertical surface 22 may intersect a plane of the second vertical surface 23 at an angle depending on the shape of the parapet 2 to be covered. Further, the dimensions of the lower vertical surface 22 may correspond with the dimensions of the corresponding portion of the parapet 2 to be covered by the cover panel 12. The lower vertical surface 22 may be perpendicular to the roadway 1. The lower vertical surface 22 may include a lower ultimate edge 30, which may be flat and may be parallel to and face the roadway 1.

The outer surface 20 may include bends or edges which may be round or squared at the intersection of respective planes or surfaces (e.g., lower vertical surface 22, second vertical surface 23, first vertical surface 24, top surface 26 and angled surface 28).

The inner surface 21 or back of the panel 12, which is opposite to the outer surface 20 and faces the concrete of the parapet 2 when installed, may consist of surfaces that are parallel to and correspond with respective portions of the outer surface 20 thereby corresponding to the shape of the parapet 2. The cover panel 12 may be doubled walled for stability and durability. In one example, one wall is the outer surface 20 and another wall is the inner surface 21. Further, the cover panel 12 may have a predetermined thickness.

For example, the inner surface 21 may include an inner lower vertical surface 32 that is parallel to the lower vertical surface 22. The inner surface 21 may include a second vertical surface 33 that is parallel to the second vertical surface 23 and may include an inner first vertical surface 34 that is parallel to the first vertical surface 24. In some implementations, the inner surface 21 includes an inner top surface and may include an inner angled surface 38 that are parallel to the top surface 26 and angled surface 28, respectively.

As further shown, each cover panel 12 has two sides, such as a first side 40 (e.g., left side of cover panel 12 in FIG. 2) and a second side 41 (e.g., right side of cover panel 12 in FIG. 2). As shown best in FIG. 2, a second side 41 of a cover panel 12 may include a first second recess portion, recessed surface or indentation 43 in the outer surface 20 that spans along the entire length of the second side 41. In some implementations, the second recess portion 43 may span a portion of the length of the second side 41. Accordingly, in some examples, one or more of the lower vertical surface 22, second vertical surface 23, first vertical surface 24, top surface 26 and angled surface 28 may have a recessed portion 41 that is lower or recessed with respect to a main portion of the respective surface of the outer surface 20. That is, the top surface of the second recessed portion 43 is not as high as the outer surface 20. The recess 41 may be uniform in depth or may have different depths along the second side 41.

On the opposite side of the second side 41, the first side 40 may include a first recessed portion, recessed surface or indentation 42 of the inner surface 21 that spans along the entire length of the first side 40. In some implementations, the first recess portion 42 may span a portion of the length of the first side 40. Accordingly, in some examples, one or more of the inner lower vertical surface 32, inner second vertical surface 33, inner first vertical surface 34, inner top surface 36 and inner angled surface 38 may have a first recessed portion 42 that is lower or recessed than a main portion of the respective surface of the inner surface 21. The first recess 42 may be uniform in depth or may have different depths along the first side 40.

In some examples, in an assembly of a modular cover panel 10, a face 46 of the first recess 42 of the first side 40 of one cover panel 12 may cover or overlap at least a portion of a face 47 of the second recess 43 of the second side 41 of another cover panel 12. That is, upon installation, an outer edge 48 of the first side 40 of one cover panel 12 may contact, abut or engage the recessed edge 45 of the second side 41 of another cover panel 12. Further, a gap or space may be permitted between the recessed edge 45 and the outer edge 48 to allow for thermal expansion, vibration or movement between the adjacent cover panels 12.

Further, in some implementations, a recessed edge 44 of the first side 40 of one cover panel 12 may contact, abut, or engage an outer edge 49 of the second side 41 of another cover panel 12. Further, a gap or space may be permitted between the recessed edge 44 and the outer edge 49 to allow for thermal expansion, vibration or movement between the adjacent cover panels 12.

Figure 8:
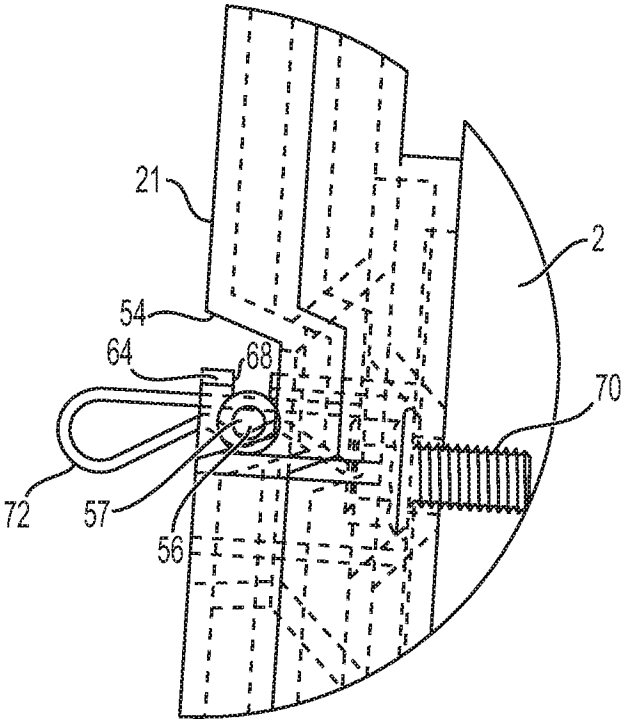
FIG. 8 illustrates an example of a cover panel installed on a parapet in a cross-sectional view according to some implementations.

Additionally, the respective depths of the first recess 42 and the second recess 43 are such that respective outer surfaces 20 and respective inner surfaces 21 of adjacent cover panels are flush or are in the same plane, as shown in FIG. 8, for example, which will be explained in more detail below. Accordingly, each cover panel 12 has the first recess 42 and the second recess 43, having the structure explained above, so that adjacent cover panels 12 may be installed to cover the parapet 2.

As further shown in FIGS. 2, 3 and 4, one or more openings, holes, or through-holes 50 may be disposed through the cover panel 12. For example, four openings 50 may be disposed in one cover panel 12. In some implementations, two openings 50 may be disposed through the first vertical surface 24 and the inner first vertical surface 34. Additionally, two openings 50 may be disposed through the second vertical surface 23 and the inner first vertical surface 33. In some instances, one or more openings 50 disposed through the first vertical surface 24 and the first inner vertical surface 34 may be aligned with one or more openings 50 disposed through the second vertical surface 23 and the inner first vertical surface 33. Additionally, an opening 50 through the first vertical surface 24 and the first inner vertical surface 34 may be disposed closer to the top surface 26 than an intersection of the second vertical surface and the first vertical surface 24. Further, an opening through the second vertical surface 23 and the inner first vertical surface 33 may be disclosed closer to the lower edge 30 than the inter section of the second vertical surface 23 and the first vertical surface 24.

Each opening may receive a bracket 60, which is used to hang or suspend the cover panel 12 upon installation on a parapet 2. That is, upon installation, a bracket 60 is affixed to a parapet 2 and a cover panel 12 hangs or is suspended on the bracket 60. Further, in some implementations, the hole 50 may be tapered or have a conical shape and a hole 51 in the outer surface 51 of the opening 50 may be less in diameter than a hole 52 in the inner surface 21 of the cover panel 12. Of course, the shape of the hole(s) may depend on the shape of the bracket 60.

In some implementations, a channel or slot 54 may be disposed in one or more portions of the outer surface 20 and the channel or slot 54 may span an entire width of the cover panel 12. An opening 50 may be disposed within the channel or slot 54. As explained in more detail below, a channel or slot 54 may receive, engage, or accommodate a cable 56 for securing the modular cover panel 10. For example, one channel 54 may be disposed in a first vertical surface 24 and another channel 54 may be disposed in a second vertical surface 23.

In some implementations, one or more stand offs or protrusions 58 may be disposed on the inner surface 21 of the cover panel 12. The stand offs 58 may be disposed in a regular pattern and in different portions of the inner surface 21 such as on the inner second vertical surface 33 and inner first vertical surface 24. The stand offs 58 may contact the concrete of the parapet 2 upon installation and therefore the outer surface 21 of the cover panel 12, besides the stand offs 58, may not contact the concrete of the parapet. This is to allow air flow, for example.

Figure 5:
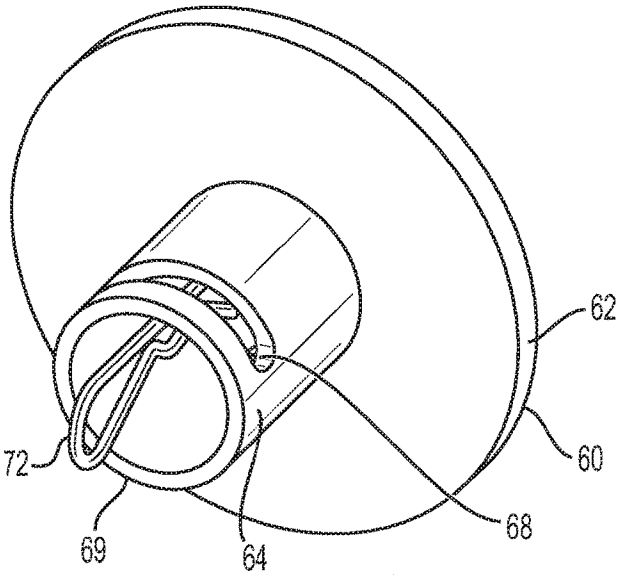
FIG. 5 illustrates an example of a perspective view of a bracket according to some implementations.
Figure 6:
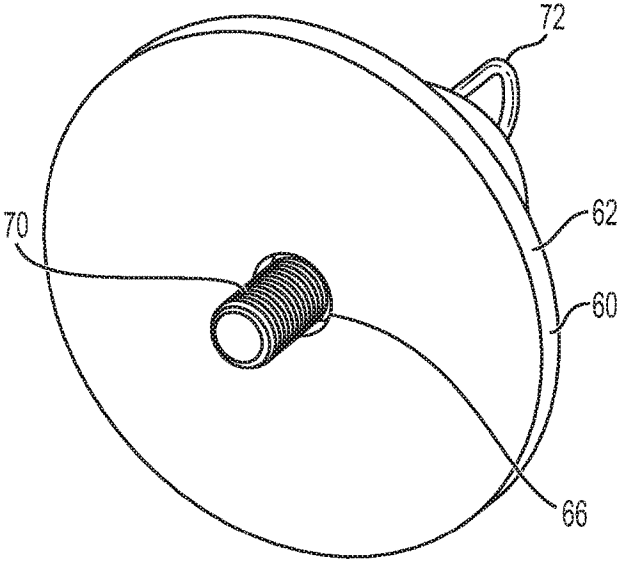
FIG. 6 illustrates an example of a perspective view of a bracket according to some implementations.

FIG. 5 illustrates an example of a perspective view of a bracket according to some implementations. FIG. 6 illustrates an example of a perspective view of a bracket according to some implementations. A bracket 60 may be affixed or attached to the outer surface of the concrete of the parapet 2 that faces the roadway 1. The bracket 60 may be affixed using a fastener 70 such as a bolt, screw or rivet. The bracket 60 may include a circular base 62 and may include a structure 64, such as a hollow cylindrical structure, extending outward from the center of the circular base 62. The structure 64 may have a different shape or profile, such as square or rectangular. The fastener 70 may be inserted through the hollow cylindrical structure and through a hole 66 the circular base 62 to bore into the concrete of the parapet 2 so that the bracket may be fixed to the parapet 2 upon installation. The circular base may abut or contact the inner surface 21 upon insertion of the structure 64 of the bracket through an opening 50. A diameter of the circular base 62 may be greater than a diameter of the one or more openings 52 in the inner surface 21. Additionally, the diameter of the structure 64 may be less than an opening 52 so that the structure 64 may fit through the cover panel 12 from the inner surface 21 (e.g., back) side of the cover panel 12. Further, the height of the structure 64 may be longer than a width of the cover panel 12 so that a channel portion 68 disposed within the structure 64 may align with the channel 54 disposed in the outer surface 20 of the cover panel 12. In some implementations, the height of the structure 64 may be such that the top surface 69 is in a same plane or flush with the outer surface 20.

As mentioned above, during installation, a cable 56 may be disposed within the channel 54 and may be disposed within the channel portion 68 of the bracket 60. In some examples, a fastener 72, such as a pin or cotter pin, may be used to engage and hold the cable 56.

Figure 7:
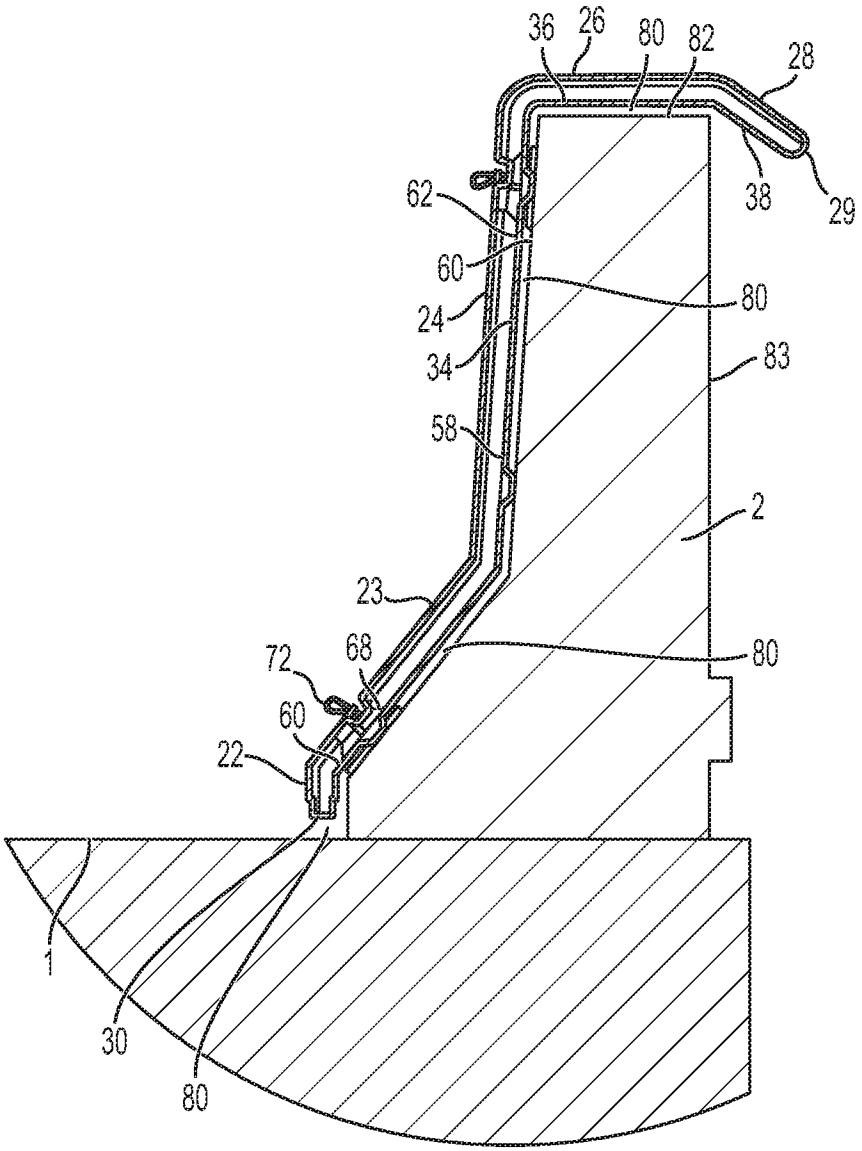
FIG. 7 illustrates an example of a perspective view of a cover panel according to some implementations.

FIG. 7 illustrates an example of a cover panel installed on a parapet in a cross-sectional view according to some implementations. Upon installation, for example, a cover panel 12 may hang or be suspended on the one or more brackets 60 and respective portions of the one or more openings 50 may engage with respective structures 64 of respective brackets 60. That is, the weight of the respective cover panels may rest on the respectively installed brackets 60. Accordingly, in some implementations, after the brackets 60 are affixed to the parapet 2 using the fastener 70, a cover panel 12 may be installed by moving the cover panel 12 toward the parapet 2 so that the one or more structures 64 of the installed brackets 60 are moved through the one or more respective openings 50 and the cover panel 12 may hang, suspend, or engage the top surfaces of the respective structures 64. In some implementations, the size of the openings 50 and the diameter of the structure 64 is such that there may be an engagement of the structure 64 and the opening 50 around the outside surface of the structure 64. In some examples, there is a gap to allow for a tolerance between a portion of the outer surface of the structure and the opening 50 and to allow for ease of installation, disassembly, thermal expansion and/or vibration, for example. The cover panel 12 may slide on and off the installed brackets 60 accordingly.

Further, the stand offs 58 may protrude toward the parapet 2 surface further than the base of the bracket 62 so that, in some examples, the base of the bracket 62 does not contact the parapet 2 surface. As shown, an air gap 80 may exist between the inner top surface 36 and the top surface 82 of the parapet 2. That is, in some examples, the inner top surface 36 may not contact the top surface of parapet 80. Therefore, in some implementations, the weight of cover panel 12 is carried by or on the brackets 60. Further, as discussed above, the outer edge 29 extends further out than an outer edge 83 of the parapet 2 so that fluid, for example, may be carried off the edge and away from the parapet and may avoid the bridge. FIG. 7 additionally shows gaps 80 between, for example, the lower edge 30 and the roadway 1, and portions of the inner surface 21 and the outer surface of the parapet 2.

FIG. 8 illustrates an example of a cover panel installed on a parapet in a cross-sectional view according to some implementations. In some examples, a cable clamp or stop 57 may be disposed at the end of a cable 56. Further, the cable 56 may be above the fastener 70 in the vertical direction. As shown, a cable 56 is placed through a slot 68 in the bracket 60 and a pin 72 may engage with the cable 56 to secure the cable 56 form a mechanical attachment. In some examples, the pin 72 is attached to the cable 56 to prevent the cable 56 from inadvertently slipping through the slot 68. By removing the pin 72, the cable 56 may be removed. Further, the cover panels 12 may each be removed for inspection of the parapet 2. Accordingly, for example, the cable 56 is secured by multiple pins 72 in respective adjacent panels 12 and therefore, with respect to one panel 12, the attachment of the cable 56 to an adjacent panel 12 also secures the one panel 12. That is, the cable 56 secured by multiple pins 72 of respective cables 56 collectively keeps the modular cover panel 10 in tact.

Figure 9:
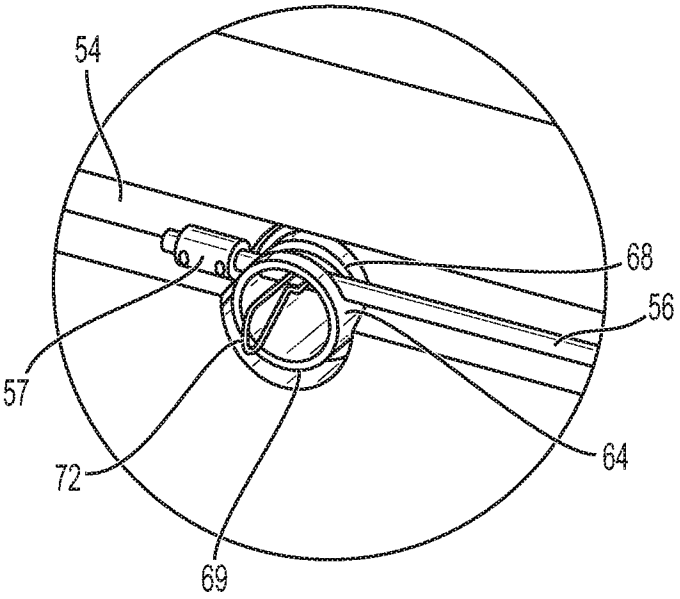
FIG. 9 illustrates an example of a portion of a cover panel according to some implementations.

FIG. 9 illustrates a portion of a cover panel according to some implementations. In some implementations, as mentioned above, a cable 56 is disposed through respective slots 68 of multiple brackets 60 of a series of cover panels 12. One bracket 60 is shown in detailed view in FIG. 9. A pin 72 may engage and secure the cable 56 through the structure 64 of the bracket 60. Further, the attachment of the pin 72 to the cable 56 that is in the slot 68 of a bracket 60 may secure the cable 56 and prevent the cable 56 from coming out of the slot 68 thereby securing the panel 12 from coming off the structure 64 as it is hanging on the structure 64 and bracket 60. As mentioned, removing the pin 72 may allow for the cable 56 to be removed from the slot 68 and therefore allows for the panel 12 to easily slide off or otherwise become disengaged from structure 64 of the bracket 60.

Figure 10:
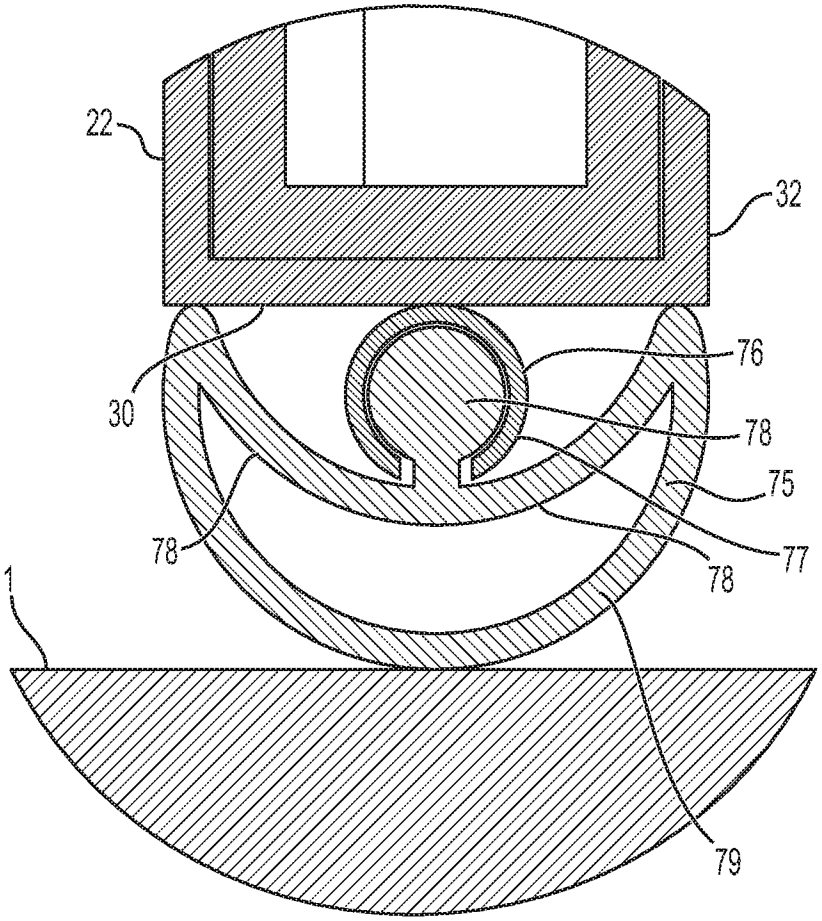
FIG. 10 illustrates an example of a bottom portion of a cover panel according to some implementations.

FIG. 10 illustrates an example of a bottom portion of a cover panel according to some implementations. In some implementations, a gasket 75 may be disposed on a lower portion of a cover panel 12, such as at the lower edge 30. A ring shaped protrusion 76 with an open slot 77 may extend from the lower edge 30 and may extend the width of the cover panel 12. The ring shaped protrusion 76 may accept and engage with a bulbous portion 78 of a gasket 75, which may be rubber or plastic. The bulbous portion 78 may be inserted into the slot 77 of the ring-shaped-protrusion 76. The gasket 75 may have a double walled construction with an inner curved portion 79 connected to the bulbous portion 78 and an outer curved portion 78 that may make contact with the roadway surface 1. The gasket 75 may absorb shock and may be used as a pivot point during installation or disassembly.

Figure 11:
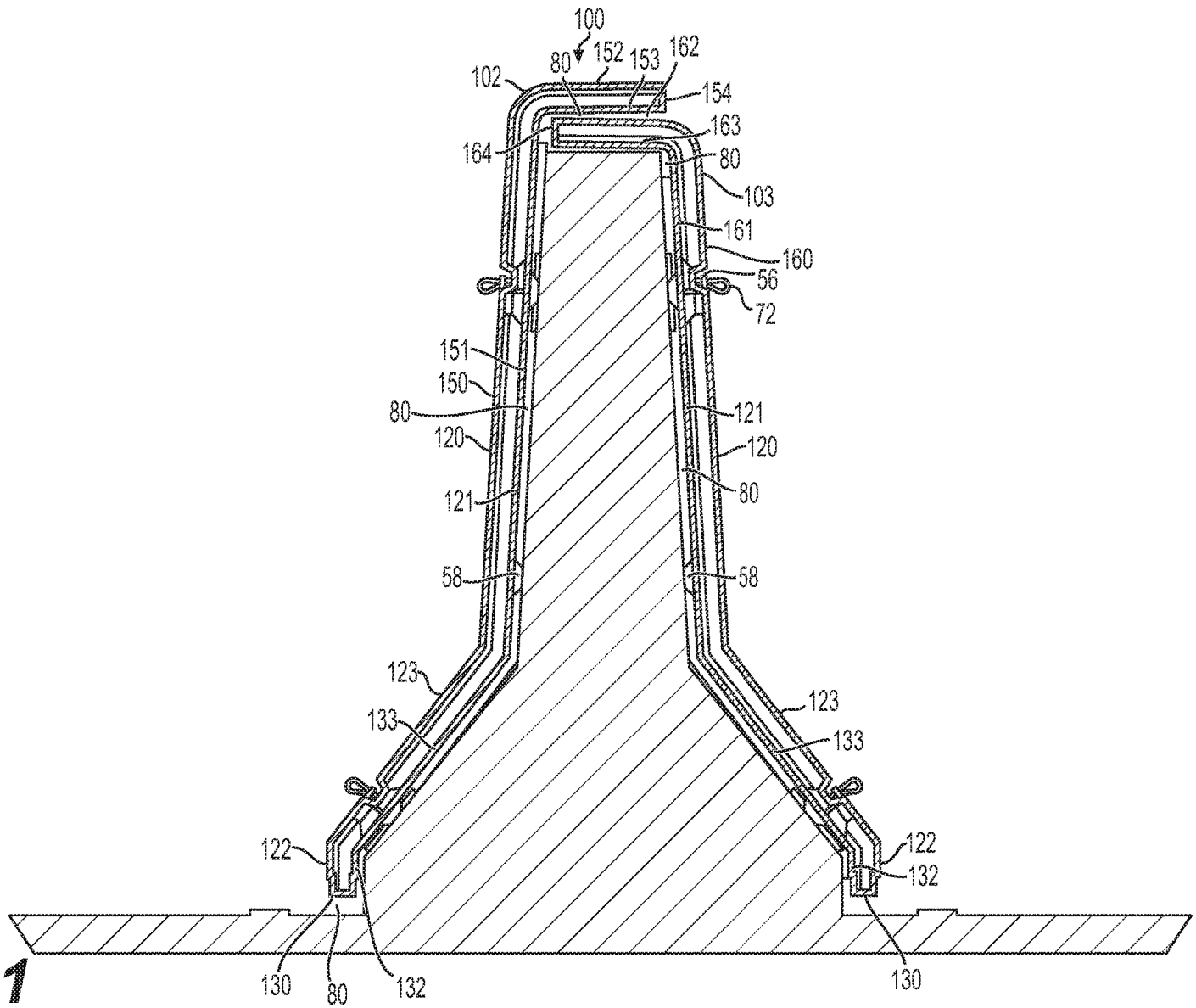
FIG. 11 illustrates an example of a modular center divider cover panel in cross-section view according to some implementations.

FIG. 11 illustrates an example of a modular center divider cover panel in cross-section view according to some implementations. FIG. 11 is a cross-section view along the line B-B in FIG. 1. FIG. 11 shows an implementation of a modular center divider cover panel 100 that may include a center divider cover panel 102 and a center divider cover panel 103. Like the cover panel 12, one purpose of the modular center divider cover panel 100 is to prevent fluids and chemicals, such as road salts, from contacting the surface of the center divider. In many instances the divider panel 102 and the divider panel 103 are similar to each other and each may have elements that are similar to the cover panel 12 described above. As explained in more detail below, the divider panel 102 overlaps the divider panel 103 above the top portion of the center divider.

For example, the divider panel 102 and the divider panel 103 may include a double wall construction with a main outer surface 120 and a main inner surface 121 each including surface portions that corresponds to one another. For example, the divider panel 102 and divider panel 103 may include a lower edge 130 parallel to the roadway below and having an air gap 80 between the lower edge 130 and the roadway. The divider panels 102, 103 may also include lower vertical surfaces 122 and corresponding inner lower vertical surfaces 123 and may include second vertical surfaces 123 and corresponding inner second vertical surfaces 133.

Further, in some instances, a center divider cover panel 102 may include a first vertical surface 150 of the outer surface 120 and corresponding inner first vertical surface 151 of the inner surface 121. A center divider cover panel 103 on the other side of the center divider may include a first vertical surface 160 of the outer surface 120 and corresponding inner first vertical surface 161 of the inner surface 121.

The first vertical surface 150 may extend upward or away from the roadway further than the first vertical surface 160. The outer surface 120 may further include a top surface 152 extending from the first vertical surface 150 and toward the divider cover panel 103. Similarly, the outer surface 120 of the divider cover panel 103 may include a top surface 162 extending from the first vertical surface 160. As shown, since the first vertical surface 150 may extend upward or away from the roadway further than the first vertical surface 160, the top portion including top surface 152 and corresponding inner top surface 153 may be disposed above the top surface 162 and overlapping at least a portion of the top surface 162 of center divider panel 103. Further, there may be an air gap 80 between the inner top surface 153 and the top surface 162. The outer edge 164 may not contact an inner surface 121 of the divider cover panel 102. There also may be an air gap 80 between inner top surface 163 and the top surface of the parapet 2, as shown.

Similar to the cover panel 12, the center divider cover panels 102, 103 may be hung, suspended, or may engage with brackets 60 upon installation. Further, the divider cover panels 102, 103 have recesses that allow for overlapping respective side portions of the panels. For example, FIG. 11 shows pins 72 holding a cable 56 and a bracket 60 may be installed on the parapet 60 and the structure 64 may extend through respective openings 50. Those details are the same or similar and are not be repeated here for brevity.

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

The invention claimed is:

1. A panel, comprising:

a front surface and a back surface that is opposite the front surface;

a first side and a second side spanning in a vertical direction along opposite sides of the panel, respectively;

wherein the front surface includes:

an essentially horizontal top surface;

a first surface contiguous and angled with respect to the top surface;

a second surface contiguous and angled with respect to the first surface; and a lower surface contiguous and angled with respect to the second surface and extending downward in the vertical direction; and a third surface contiguous and angled with respect to the top surface and extending downward;

wherein the lower surface is lower than the second surface, which is lower than the first surface, which is lower than the top surface in the vertical direction, wherein at least two through-holes are respectively disposed through the front surface and the back surface, and wherein a channel is disposed in the front surface that intersects two of the at least two through-holes and spans in a width direction that is orthogonal to the vertical direction.

2. The panel of claim 1, wherein the first side includes a first recessed surface of the back surface, and wherein the second side includes a second recessed surface of the front surface.

3. The panel of claim 1, wherein two or more protrusions are disposed on the back surface and protrude outward from the back surface.

4. The panel of claim 1, wherein a diameter of an opening at the front surface of each of the at least two through-holes is less than a diameter of an opening at the back surface of each of the at least two through-holes.

5. The panel of claim 1, wherein the top surface, the first surface, the second surface, the lower surface and the third surface are each planar surfaces.

6. The panel of claim 1, wherein the lower surface has a bottom surface between the front surface and the back surface, wherein a ring shaped protrusion having an opening protrudes from the bottom surface.

7. A modular panel system installed on a parapet of a roadway, comprising:

two panels, each comprising:

a front surface and a back surface that is opposite the front surface;

a first side and a second side spanning in a vertical direction along opposite sides of the panel, respectively;

wherein the front surface of each of the two panels includes:

an essentially horizontal top surface;

a first surface contiguous and angled with respect to the top surface;

a second surface contiguous and angled with respect to the first surface; and a lower surface contiguous and angled with respect to the second surface and extending downward in the vertical direction; and a third surface contiguous and angled with respect to the top surface and extending downward, wherein the lower surface is lower than the second surface, which is lower than the first surface, which is lower than the top surface in the vertical direction, wherein at least two through-holes are respectively disposed through the front surface and the back surface in each of the two panels, wherein the first side includes a first recessed surface of the back surface of each of the two panels, wherein the second side includes a second recessed surface of the front surface of each of the two panels, wherein the first recessed surface of a first panel of the two panels overlaps the second recessed surface of a second panel of the two panels, and wherein a first channel is disposed in the front surface of each of the first panel and the second panel that respectively intersects two of the at least two through-holes of the first panel and the second panel and spans in a width direction that is orthogonal to the vertical direction.

8. The modular panel system of claim 7, further comprising:

a plurality of brackets respectively disposed in the through-holes and each having a cylindrical portion protruding through the respective through-holes in the first panel and the second panel, wherein each of the two panels is suspended on two or more of the brackets, which are fixed to the parapet.

9. The modular panel system of claim 8, wherein two or more protrusions are disposed on the back surface of each of the two panels and at least one of the two protrusions of each of the two panels contacts a surface of the parapet such that a gap is between the back surface of each of the two panels and the surface of the parapet.

10. The modular panel system of claim 8, wherein a first cable is disposed across the first panel and the second panel and is disposed in the first channel of the first panel and the first channel of the second panel, wherein the first cable is disposed in respective slots of each of the cylindrical protrusions of the brackets among the plurality of brackets, which are disposed in the first channel of the first panel and the first channel of the second panel.

11. The modular panel system of claim 10, wherein a second channel is disposed in the front surfaces of each of the first panel and the second panel, wherein a second cable is disposed across the first panel and the second panel and is disposed in the second channel of the first panel and the second channel of the second panel, wherein the second cable is disposed in respective slots of each of the cylindrical protrusions of the brackets among the plurality of brackets which are disposed in the second channel.

12. The modular panel system of claim 8, wherein a portion of the back surface opposite the top surface of each of the first panel and the second panel is elevated above a top surface of the parapet such that a gap is between the top surface of the parapet and the portion of the back surface opposite the top surface.

13. The modular panel system of claim 7, wherein a diameter of an opening at the front surface of each of the at least two through-holes is less than a diameter of an opening at the back surface of each of the at least two through-holes.

14. The modular panel system of claim 7, wherein the third surface of each of the first panel and the second panel extends further outward than a back side surface of the parapet.

15. The modular panel system of claim 7, wherein the lower surface of each of the first panel and the second panel has a bottom surface between the front surface and the back surface, and wherein the respective bottom surfaces of the lower surfaces are elevated above a surface of the roadway.

16. The modular panel system of claim 15, wherein a ring shaped protrusion having an opening protrudes from the bottom surface of each of the first panel and the second panel.

17. The modular panel system of claim 7, wherein the top surface, the first surface, the second surface, the lower surface and the third surface of each of the first panel and the second panel are planar surfaces.

18. A modular panel system for covering a center divider of a road, comprising:

a first panel, comprising:

a front surface and a back surface that is opposite the front surface;

a first side and a second side spanning in a vertical direction along opposite sides of the panel, respectively;

wherein the front surface of the first panel includes:

an essentially horizontal top surface;

a first surface contiguous and angled with respect to the top surface;

a second surface contiguous and angled with respect to the first surface;

a lower surface contiguous and angled with respect to the second surface and extending downward in the vertical direction;

a second panel, comprising:

a front surface and a back surface that is opposite the front surface;

a first side and a second side spanning in the vertical direction along opposite sides of the panel, respectively;

wherein the front surface of the second panel includes:

an essentially horizontal top surface;

a first surface contiguous and angled with respect to the top surface;

a second surface contiguous and angled with respect to the first surface;

a lower surface contiguous and angled with respect to the second surface and extending downward in the vertical direction, wherein the top surface of the first panel overlaps the top surface of the second panel in the vertical direction, wherein a length in the vertical direction of the first surface of the first panel is greater than a length in the vertical direction of the first surface of the second panel, wherein two or more through-holes are respectively disposed through the front surface and the back surface of each of the first panel and the second panel, wherein a first channel is disposed in the front surface of the first panel that intersects two of the at least two through-holes and spans in a width direction that is orthogonal to the vertical direction, and wherein a second channel is disposed in the front surface of the second panel that intersects two of the at least two through-holes and spans in the width direction that is orthogonal to the vertical direction.

19. The modular panel system of claim 18, further comprising:

a third panel having the same configuration of the first panel; and a fourth panel having the same configuration of the second panel, wherein the first side of the first panel and the third panel includes a first recessed surface of the back surface, wherein the second side of the first panel and the third panel includes a second recessed surface of the front surface, wherein the first recessed surface of the first panel overlaps the second recessed surface of the third panel, wherein the first side of the second panel and the fourth panel includes a first recessed surface of the back surface, and wherein the second side of the second panel and the fourth panel includes a second recessed surface of the front surface, and wherein the first recessed surface of the fourth panel overlaps the second recessed surface of the second panel.

20. The modular panel system of claim 18, wherein the modular panel system further comprises four or more brackets respectively disposed in the through-holes and each having a cylindrical portion protruding through the respective through-holes wherein the first panel and the second panel are suspended on the brackets, which are fixed to the center divider.

21. The modular panel system of claim 20, wherein a diameter of an opening at the front surface of each of the through-holes is less than a diameter of an opening at the back surface of each of the through-holes.

22. The modular panel system of claim 19, wherein two or more through-holes are respectively disposed through each of the front surface and the back surface of each of the third panel, and the fourth panel, wherein a plurality of brackets are respectively disposed in the two or more through-holes of each of the first panel, the second panel, the third panel and the fourth panel and each having a cylindrical portion protruding through the respective through-holes, wherein the first channel is disposed in the front surface of the third panel, wherein a first cable is disposed across the first panel and the third panel and is disposed in the first channel of the first panel and the first channel of the third panel, wherein the first cable is disposed in respective slots of each of the cylindrical protrusions of the brackets among the plurality of brackets which are disposed in the first channel of the first panel and the first channel of the third panel, wherein the second channel is disposed in the front surface of the fourth panel, wherein a second cable is disposed across the second panel and the fourth panel and is disposed in the second channel of the second panel and the second channel of the fourth panel, and wherein the second cable is disposed in respective slots of each of the cylindrical protrusions of the brackets among the plurality of brackets which are disposed in the second channel of the second panel and the second channel of the fourth panel.

23. The modular panel system of claim 19, wherein two or more protrusions are disposed on the back surface of each of the first panel, second panel, third panel and fourth panel and at least one of the two protrusions of each of the first panel, second panel, third panel and fourth panel contact a surface of the parapet such that a gap is between the back surfaces of each of the first panel, second panel, third panel and fourth panel and the surface of the parapet.

24. The modular panel system of claim 18, wherein the top surface, the first surface, the second surface, and the lower surface of each of the first panel, the second panel, a third panel and a fourth panel are planar surfaces.

25. The modular panel system of claim 18, wherein the lower surface of each of the first panel and the second panel has a bottom surface between the front surface and the back surface, and wherein the respective bottom surfaces of the lower surfaces are elevated above a surface of the roadway.

26. The modular panel system of claim 18, wherein a portion of the back surface opposite the top surface of the second panel is elevated above a top surface of the center divider such that a gap is between the top surface of the center divider and the portion of the back surface of the second panel.

27. The modular panel system of claim 26, wherein a portion of the back surface opposite the top surface of the first panel is elevated above the top surface of the second panel such that a gap is between the top surface of the second panel and the portion of the back surface of the first panel.

* * * * *